United States Patent [19]

Fisher

[11] Patent Number: 4,532,504

[45] Date of Patent: Jul. 30, 1985

[54] SLEW LENGTH TIMER

[75] Inventor: Paul A. Fisher, Mesa, Ariz.

[73] Assignee: Sperry Corporation, New York, N.Y.

[21] Appl. No.: 416,397

[22] Filed: Sep. 9, 1982

[51] Int. Cl.[3] ..... G09G 1/08

[52] U.S. Cl. ..... 340/739; 340/742; 340/743

[58] Field of Search ..... 340/739, 740, 742, 743, 340/736, 732

[56] References Cited

U.S. PATENT DOCUMENTS

| | | | |
|---|---|---|---|
| 3,539,860 | 10/1970 | Max et al. | 340/742 |
| 3,746,912 | 7/1973 | Redecker et al. | 340/742 |
| 3,786,483 | 1/1974 | Sinobad | 340/742 |
| 3,952,297 | 4/1976 | Stauffer et al. | 340/740 |
| 4,093,996 | 6/1978 | Hogan et al. | 340/739 |

*Primary Examiner*—Marshall M. Curtis

*Attorney, Agent, or Firm*—Howard P. Terry; Seymour Levine

[57] ABSTRACT

A slew length timer generates a variable time delay to signal the end of slew to a display symbol generator. Two memories, one for each deflection channel, are addressed by the starting and ending beam positions in a corresponding channel and programmed to provide coded output signals representative of the delay for that channel. A third memory receives the output signals from the two prior memories as its address and provides a binary count of the longer of the two delays specified by the first two memories. This binary count is coupled through the control terminals of a variable delay which provides an end of slew signal in accordance therewith.

9 Claims, 1 Drawing Figure

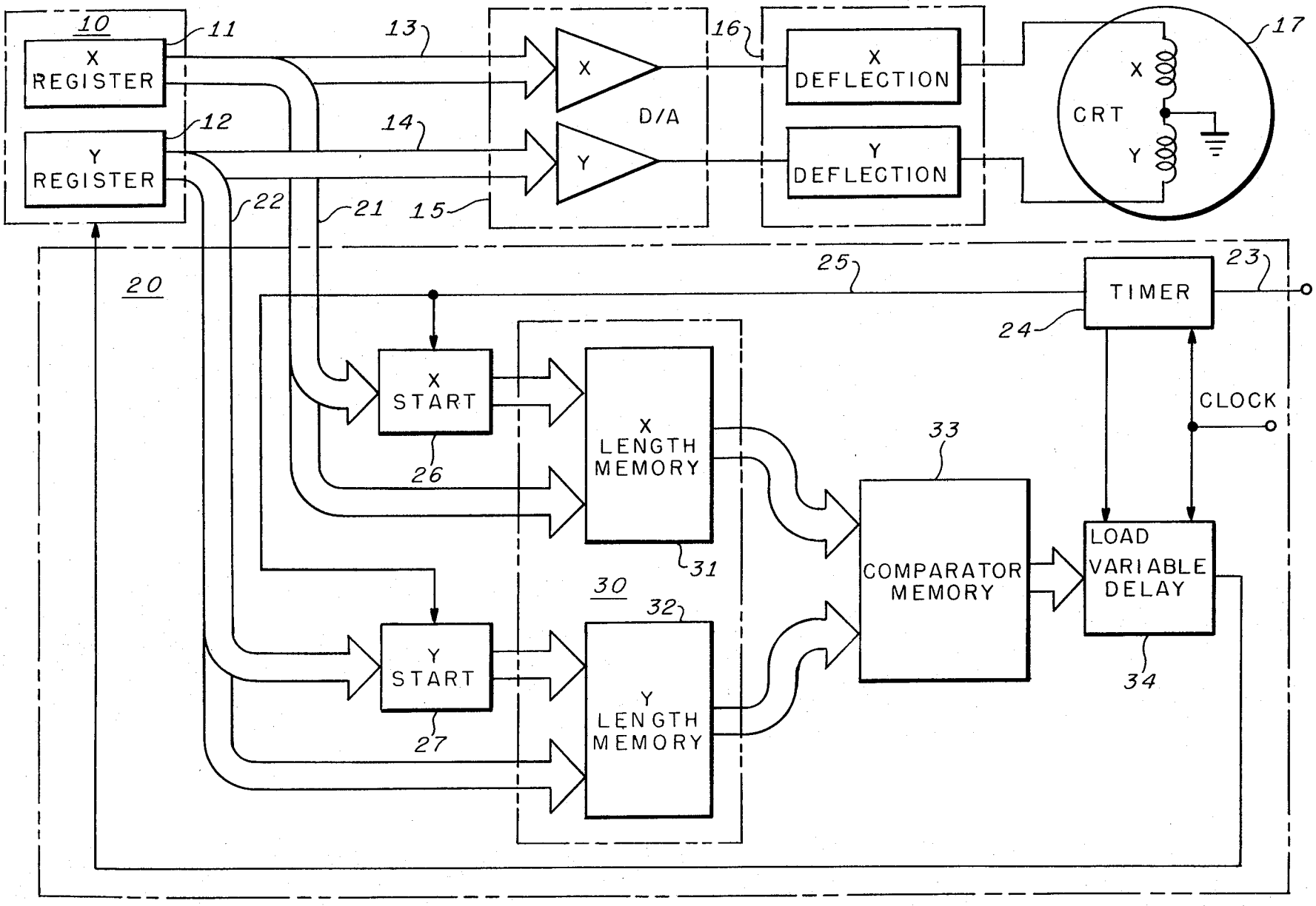
17
CRT
X
Y
X DEFLECTION
Y DEFLECTION
16
D/A
X
Y
13
14
15
21
22
11
12
10
X REGISTER
Y REGISTER
20
23
TIMER
24
CLOCK
LOAD VARIABLE DELAY
34
COMPARATOR MEMORY
33
25
X LENGTH MEMORY
31
Y LENGTH MEMORY
32
30
X START
26
Y START
27

SLEW LENGTH TIMER

BACKGROUND OF THE INVENTION

1. Field of the Invention

The invention pertains to display systems and more particularly to the determination of the time interval between the start and end of a segment on the display.

2. Description of the Prior Art

Before start and end position signals for a symbol are coupled from a symbol generator to a display unit, the generator must receive a signal indicating that the prior symbol has been completed. In prior art CRT display systems circuitry coupled to the deflection amplifiers, that detect when the beam of the CRT has stopped, generate a signal at the conclusion of a symbol segment. This signal is coupled to the logic circuitry of the symbol generator, which waits until the signal is received before proceeding with the next symbol segment. When multiple redundant display units are driven from the same symbol generator, end signals must be received from all of the display units before the next symbol commands are issued. Logic must therefore be included in the symbol generator to prevent the delay of subsequent signal generation from an inordinate length of time due to a delayed or missing signal from a faulty display unit.

Other prior art systems incorporate waiting commands into the program controlling the symbol generator. This provides acceptable performance when the symbology is stationary. If the symbology, however, moves, or symbols are added or deleted to the middle of the program, the delay commands must be adjusted, a process requiring appreciable additional computation.

The prevent invention eliminates these problems by providing and end of slew signal that is related to the actual beam movement.

SUMMARY OF THE INVENTION

According to the principles of the present invention, digital data representative of the beam position on the display face is coupled from a vector symbol generator to address a length memory. The display is divided into regions by segmenting the axes. Slew time between regions for all combination of start and end positions in an axis are represented by a code for each combination which is entered into a corresponding cell of the length memories. These codes, one for each axis, when addressed by the data from the symbol generator, are coupled to address an elapsed time memory, wherein each location contains a code representative of the time required to slew the beam between the start and end positions represented by the addressing code. The code at the addressed position of the elapsed time memory may then be applied to a counter, wherefrom a signal is coupled to the symbol generator at the conclusion of a count determined by the code coupled from the elapsed time memory to indicate the conclusion of the slew. Thus, the symbol generator is allowed to proceed with the next symbol segment.

BRIEF DESCRIPTION OF THE DRAWINGS

The sole FIGURE is a block diagram of a circuit embodying the principles of the invention.

DESCRIPTION OF THE PREFERRED EMBODIMENT

The present invention may be used with a calligraphic display that receives symbol display information from a digital vector generator. Such a generator can command a change in the position of the CRT beam simply by clocking a new digital value into the proper register. This digital value is converted to an analog signal, amplified, and used to drive the CRT deflection means. The analog portions of the circuit require a significant amount of time to respond to the instantaneous change in the digital value. This response time varies as a function of the start and finish positions of the slew. Thus it is necessary to provide a variable delay between the position command from the vector generator and the signal indicating the end of the slew to the vector generator. These delays can vary over an order of magnitude, depending upon the start and end positions of the slew, 8 microseconds to 100 microseconds being a typical range.

Referring now to the FIGURE, digital signals representative of the desired beam position are coupled from the symbol (vector) generator 10 wherein the coordinates of each start and end position are entered into the X register 11 and Y register 12. The digital signals in registers 11 and 12 are coupled via busses 13 and 14 to a digital-analog converter 15 wherefrom analog signals are coupled via deflection amplifiers 16 to the CRT 17.

Digital signals, for an n-bit code, which may comprise the four most significant bits of the position signals coupled to the busses 13 and 14, are coupled from the X register 11 and Y register 12 to the slew length timer 20 via busses 21 and 22, respectively. These four bit digital signals divide the X and Y axes of the CRT display into 16 segments, each uniquely represented by one of the possible 16 4-bit codes on the bus assigned to the axis on which the segment lies. Thus, the display is divided into 256 regions, each uniquely represented by an 8 bit signal, 4 bits for the X segment and 4 bits for the Y segment. The utilization of the 4 significant bits provides appreciable savings in memory sizes throughout the system while maintaining useful symbol length and position information.

Prior to commanding a new beam position a signal is coupled from the symbol generator 10 via line 23 to timer 24. In response to this signal timer 24 clocks registers 26 and 27 via line 25 thereby storing the 4-bit X coordinate of the start position in register 26 and the 4-bit Y coordinate of the start position in register 27. The X and Y coordinates of the start position are latched in registers 26 and 27 and coupled therefromto X length memory 31 and Y length memory 32 of length memory 30. After the initial coordinates are stored in the X start register 26 and the Y start register 27, digital signals representative of the coordinates of the final position of the slew are entered into the X register 11 and the Y register 12 of the vector generator 10. The 4 most significant bits of each of these signals are respectively coupled, via busses 21 and 22, to the X length memory 31 and the Y length memory 32.

Length memory 31 and length memory 32 are each addressed by 8 bit words, four bits for the starting and 4 bits for the end position. Thus each memory location corresponds to a slew from an initial region, one of the 16 regions along an axis, to an end region on the same axis. In this manner information concerning the direction and approximate magnitude of slew is preserved in 8 bits. The 256 possible combinations of the start and end positions along an axis, representing the one axis slew time, are arranged in order and divided into 32 groups of 8, each group represented by a m-bit code, such that $m<2n$. In one embodiment m may equal 5 to establish a 5 bit word unique for the group. This group code is inserted at the memory position of each member of the group. It should be apparent to those skilled in the art that identical codes in the X and Y length memories need not necessarily represent equal time intervals. In a rectangular display a slew between corresponding initial start regions and corresponding initial end regions could provide lengths that are significantly different.

The two five bit codes that are addressed in the X length memory 31 and Y length memory 32 are coupled to comparator memory 33 wherein a cell is uniquely assigned to each X length-Y length pair. Each X length and Y length corresponds to a deflection time interval on the CRT display. These time intervals are compared for each X length-Y length pair and the greater of the two is selected to be respresentative thereof.

Stored in the comparator memory, which is addressed by the two 5 bit X length Y length codes, is the code required by the variable delay 34 to produce the time interval selected for that X length Y length pair. In one embodiment of the invention the selected time intervals are arranged in order and divided into groups of four, each group being assigned a unique p-bit code, which may on 8-bit code, satisfying the inequality $p<2m$. Other embodiments p may be equal to or greater than 2m, p being determined by the input code to the variable delay 34.

Upon receipt of a timing signal from timer 24, variable delay 34 loads the binary code addressed in comparator memory 33 by the X length memory 31 and Y length memory 32. This timing signal occurs after the initial position is latched into the X start register 26 and Y start register 27, X register 11 and Y register 12 of vector generator 10 have received the end beam position, and after the resulting binary signals are propagated through the memory to the input terminals of the variable delay 34. Variable delay 34, which may be a parallel loaded binary counter well known in the art, provides a signal to the vector generator 10 after a time delay determined by the code coupled to its input terminals. This pulse signals the end of slew to the vector generator 10 which then proceeds with the next symbol segment.

While the invention has been described in its preferred embodiments, it is to be understood that the words which have been used are words of description rather than limitation and that changes may be made within the purview of the appended claims without departing from the true scope and spirit of the invention in its broader aspects.

I claim:

1. An apparatus for utilization with a symbol generator for a display having a coordinate system with orthogonal first and second display axes comprising:

means coupled to receive signals from said symbol generator signifying first and second display axes start and end positions for providing signals representative of slewing time intervals between said start and end positions for each of said first and second display axes;

comparator means coupled to receive said first and second display axis slewing time representative signals for providing a coded signal representative of a slew time interval for said start and end positions by selecting one of said first and second display axis slewing time intervals of longer duration and providing a signal representative of said selected one coordinate slew time interval; and means responsive to said signal representative of said slew time interval for providing an end of slew signal to said symbol generator.

2. An apparatus in accordance with claim 1 wherein said coordinate slewing time interval determining means includes first memory means, having stored therein signals representative of time intervals between a plurality of start and end position pairs on said first display axis, coupled to said symbol generator to receive signals representative of start and end positions along said first display axis as an addressing code and second memory means, having stored therein signals representative of time intervals between a plurality of start and end position pairs on said second display axis coupled to said symbol generator to receive signals representative of start and end positions along said second display axis as an addressing code.

3. An apparatus in accordance with claim 2 wherein first and second registers are respectively coupled between said first and second timer interval memory means for latching signals of start positions along said first and second axes received from said symbol generator.

4. An apparatus in accordance with claims 1, 2, or 3 wherein said signals representative of said start and end positions received from said symbol generator are digital signals and include n most significant bits of digital signals coupled from said symbol generator to drive said display.

5. An apparatus in accordance with claim 4 wherein said first and second time interval memory means include $2^{2n}$ memory cells wherein said time interval memory signals are digital and contain m bits, where $m<2n$.

6. An apparatus in accordance with claim 5 wherein said comparator means includes a memory having $2^{2m}$ memory cells and wherein a 2m bit code coupled from said length determining means to said comparator means addresses a memory cell therein to provide a p bit code representative of slew time between a start and end position pair to said end of slew signal means to establish said end of slew signal.

7. An apparatus in accordance with claim 6 wherein said p bit code in each memory cell of said comparator means is representative of the longer slew time interval between paired slew time intervals along said first and second axes corresponding to said memory cell in said comparator means.

8. An apparatus in accordance with claim 6 wherein $p<2m$.

9. An apparatus in accordance with claim 6 wherein $p>2m$.

* * * * *